US008641885B2

(12) United States Patent
Sivasankar et al.

(10) Patent No.: US 8,641,885 B2
(45) Date of Patent: Feb. 4, 2014

(54) MULTIPHASE ELECTROCHEMICAL REDUCTION OF $CO_2$

(71) Applicant: Liquid Light, Inc., Monmouth Junction, NJ (US)

(72) Inventors: Narayanappa Sivasankar, Plainsboro, NJ (US); Jerry J. Kaczur, North Miami Beach, FL (US); Emily Barton Cole, Houston, TX (US)

(73) Assignee: Liquid Light, Inc., Monmouth Junction, NJ (US)

( * ) Notice: Subject to any disclaimer, the term of this patent is extended or adjusted under 35 U.S.C. 154(b) by 0 days.

(21) Appl. No.: 13/724,522

(22) Filed: Dec. 21, 2012

(65) Prior Publication Data

US 2013/0118911 A1 May 16, 2013

Related U.S. Application Data

(60) Provisional application No. 61/701,358, filed on Sep. 14, 2012, provisional application No. 61/720,670, filed on Oct. 31, 2012, provisional application No. 61/703,229, filed on Sep. 19, 2012, provisional application No. 61/703,158, filed on Sep. 19, 2012, provisional application No. 61/703,175, filed on Sep. 19, 2012, provisional application No. 61/703,231, filed on Sep. 19, 2012, provisional application No. 61/703,232, filed on Sep. 19, 2012, provisional application No. 61/703,234, filed on Sep. 19, 2012, provisional application No. 61/703,238, filed on Sep. 19, 2012, provisional application No. 61/703,187, filed on Sep. 19, 2012, provisional application No. 61/675,938, filed on Jul. 26, 2012.

(51) Int. Cl.
*C25B 3/00* (2006.01)
*C25B 1/00* (2006.01)

(52) U.S. Cl.
USPC ..... 205/455; 205/413; 205/440; 205/446; 205/448; 205/450; 205/555

(58) Field of Classification Search
USPC ..... 205/413, 440, 446, 448, 450, 455, 555
See application file for complete search history.

(56) References Cited

U.S. PATENT DOCUMENTS 3,019,256 A 1/1962 Dunn
3,293,292 A 12/1966 Olivier et al.

(Continued)

FOREIGN PATENT DOCUMENTS

CA 1146120 A1 5/1983
CA 1272161 A1 7/1990

(Continued)

OTHER PUBLICATIONS

Green et al., "Vapor-Liquid Equilibria of Formaldehyde-Methanol-Water", Industrial and Engineering Chemistry (Jan. 1955), vol. 47, No. 1, pp. 103-109.

(Continued)

*Primary Examiner* — Edna Wong
(74) *Attorney, Agent, or Firm* — Suiter Swantz pc llo

(57) ABSTRACT

Disclosed is a system and method for reducing carbon dioxide into a carbon based product. The system includes an electrochemical cell having a cathode region which includes a cathode and a non-aqueous catholyte; an anode region having an anode and an aqueous or gaseous anolyte; and an ion permeable zone disposed between the anode region and the cathode region. The ion permeable zone is at least one of (i) the interface between the anolyte and the catholyte, (ii) an ion selective membrane; (iii) at least one liquid layer formed of an emulsion or (iv) a hydrophobic or glass fiber separator. The system and method includes a source of energy, whereby applying the source of energy across the anode and cathode reduces the carbon dioxide and produces an oxidation product.

9 Claims, 2 Drawing Sheets

(56) References Cited

U.S. PATENT DOCUMENTS

| | | | | |
|---|---|---|---|---|
| 3,326,998 | A | 6/1967 | Reusser et al. | |
| 3,341,615 | A | 9/1967 | Wulf et al. | |
| 3,341,616 | A | 9/1967 | Vives | |
| 3,352,935 | A | 11/1967 | Mahan | |
| 3,361,653 | A | 1/1968 | Miller | |
| 3,401,100 | A | 9/1968 | Macklin | |
| 3,492,209 | A | 1/1970 | Miller | |
| 3,560,354 | A | 2/1971 | Young | |
| 3,607,962 | A | 9/1971 | Krekeler et al. | |
| 3,636,159 | A | 1/1972 | Solomon | |
| 3,720,591 | A * | 3/1973 | Skarlos | 562/597 |
| 3,745,180 | A | 7/1973 | Rennie | |
| 3,764,492 | A | 10/1973 | Baizer et al. | |
| 3,779,875 | A | 12/1973 | Michelet | |
| 4,072,583 | A | 2/1978 | Hallcher et al. | |
| 4,087,470 | A | 5/1978 | Suzuki | |
| 4,088,682 | A | 5/1978 | Jordan | |
| 4,162,948 | A | 7/1979 | Yagii et al. | |
| 4,219,392 | A | 8/1980 | Halmann | |
| 4,245,114 | A | 1/1981 | Peltzman | |
| 4,256,550 | A | 3/1981 | Niinobe et al. | |
| 4,343,690 | A | 8/1982 | de Nora | |
| 4,381,978 | A | 5/1983 | Gratzel et al. | |
| 4,450,055 | A | 5/1984 | Stafford | |
| 4,476,003 | A | 10/1984 | Frank et al. | |
| 4,523,981 | A | 6/1985 | Ang et al. | |
| 4,547,271 | A | 10/1985 | Bharucha et al. | |
| 4,595,465 | A | 6/1986 | Ang et al. | |
| 4,608,132 | A | 8/1986 | Sammells | |
| 4,608,133 | A | 8/1986 | Morduchowitz et al. | |
| 4,619,743 | A | 10/1986 | Cook | |
| 4,661,422 | A | 4/1987 | Marianowski et al. | |
| 4,673,473 | A * | 6/1987 | Ang et al. | 205/441 |
| 4,702,973 | A | 10/1987 | Marianowski | |
| 4,732,655 | A | 3/1988 | Morduchowitz et al. | |
| 4,902,828 | A | 2/1990 | Wickenhaeuser et al. | |
| 4,968,393 | A | 11/1990 | Mazur et al. | |
| 5,074,974 | A | 12/1991 | Toomey, Jr. | |
| 5,107,040 | A | 4/1992 | Repman et al. | |
| 5,155,256 | A | 10/1992 | Chapman | |
| 5,198,086 | A | 3/1993 | Chlanda et al. | |
| 5,290,404 | A | 3/1994 | Toomey | |
| 5,412,150 | A | 5/1995 | Wessel | |
| 5,514,492 | A | 5/1996 | Marincic et al. | |
| 5,654,493 | A | 8/1997 | Wessel | |
| 5,804,045 | A | 9/1998 | Orillon et al. | |
| 6,251,256 | B1 | 6/2001 | Blay et al. | |
| 6,380,446 | B1 | 4/2002 | Drew et al. | |
| 6,465,699 | B1 | 10/2002 | Grosso | |
| 6,777,571 | B2 | 8/2004 | Chaturvedi et al. | |
| 7,462,752 | B2 | 12/2008 | Fong et al. | |
| 7,883,610 | B2 | 2/2011 | Monzyk et al. | |
| 8,313,634 | B2 | 11/2012 | Bocarsly et al. | |
| 2001/0026884 | A1 | 10/2001 | Appleby et al. | |
| 2002/0022753 | A1 | 2/2002 | Drew et al. | |
| 2006/0102468 | A1 | 5/2006 | Monzyk et al. | |
| 2007/0004023 | A1 | 1/2007 | Trachtenberg et al. | |
| 2007/0012577 | A1 | 1/2007 | Bulan et al. | |
| 2007/0224479 | A1 | 9/2007 | Tadokoro et al. | |
| 2008/0223727 | A1 | 9/2008 | Oloman et al. | |
| 2008/0248350 | A1 | 10/2008 | Little et al. | |
| 2008/0283411 | A1 | 11/2008 | Eastman et al. | |
| 2008/0296146 | A1 | 12/2008 | Toulhoat et al. | |
| 2008/0314758 | A1 | 12/2008 | Grosso | |
| 2009/0014336 | A1 | 1/2009 | Olah et al. | |
| 2009/0030240 | A1 | 1/2009 | Olah et al. | |
| 2010/0187123 | A1 | 7/2010 | Bocarsly et al. | |
| 2010/0187125 | A1 | 7/2010 | Sandoval et al. | |
| 2010/0191024 | A1 | 7/2010 | Uenveren et al. | |
| 2010/0196800 | A1 | 8/2010 | Markoski et al. | |
| 2010/0248042 | A1 | 9/2010 | Nakagawa et al. | |
| 2010/0270167 | A1 | 10/2010 | McFarland | |
| 2010/0330435 | A1 | 12/2010 | Nemeth et al. | |
| 2011/0083968 | A1 | 4/2011 | Gilliam et al. | |
| 2011/0114501 | A1 | 5/2011 | Teamey et al. | |
| 2011/0114502 | A1 | 5/2011 | Cole et al. | |
| 2011/0114503 | A1 | 5/2011 | Sivasankar et al. | |
| 2011/0114504 | A1 | 5/2011 | Sivasankar et al. | |
| 2011/0143929 | A1 | 6/2011 | Sato et al. | |
| 2011/0186441 | A1 | 8/2011 | LaFrancois et al. | |
| 2011/0226632 | A1 | 9/2011 | Cole et al. | |
| 2011/0237830 | A1 | 9/2011 | Masel | |
| 2012/0004448 | A1 | 1/2012 | Bhattacharyya et al. | |
| 2012/0004449 | A1 | 1/2012 | Bhattacharyya | |
| 2012/0004454 | A1 | 1/2012 | Bhattacharyya et al. | |
| 2012/0043301 | A1 | 2/2012 | Arvin et al. | |
| 2012/0215034 | A1 | 8/2012 | McFarland | |
| 2012/0228147 | A1 | 9/2012 | Sivasankar et al. | |
| 2012/0292196 | A1 | 11/2012 | Albrecht et al. | |
| 2012/0295172 | A1 | 11/2012 | Peled et al. | |
| 2012/0298522 | A1 | 11/2012 | Shipchandler et al. | |
| 2012/0329657 | A1 | 12/2012 | Eastman et al. | |
| 2013/0062216 | A1 | 3/2013 | Yotsuhashi et al. | |
| 2013/0098772 | A1 | 4/2013 | Bocarsly et al. | |
| 2013/0105304 | A1 | 5/2013 | Kaczur et al. | |
| 2013/0105330 | A1 | 5/2013 | Teamey et al. | |
| 2013/0118911 | A1 | 5/2013 | Sivasankar et al. | |
| 2013/0134048 | A1 | 5/2013 | Teamey et al. | |
| 2013/0134049 | A1 | 5/2013 | Teamey et al. | |
| 2013/0140187 | A1 | 6/2013 | Teamey et al. | |
| 2013/0180863 | A1 | 7/2013 | Kaczur et al. | |

FOREIGN PATENT DOCUMENTS

| | | | |
|---|---|---|---|
| CA | 2043256 | A1 | 12/1991 |
| CA | 2391938 | A1 | 5/2001 |
| DE | 1047765 | A | 12/1958 |
| DE | 2301032 | A | 7/1974 |
| FR | 853643 | | 3/1940 |
| GB | 1096847 | A | 12/1967 |
| GB | 1584524 | A | 4/1977 |
| GB | 2038335 | A | 7/1980 |
| GB | 2312218 | A | 10/1997 |
| JP | 64-015388 | | 1/1989 |
| WO | WO 9724320 | A1 | 7/1997 |
| WO | WO 0015586 | A1 | 3/2000 |
| WO | WO0138275 | A1 | 5/2001 |
| WO | WO 2004067673 | A1 | 8/2004 |
| WO | 2007041872 | A1 | 4/2007 |
| WO | WO 2007041872 | A1 | 4/2007 |
| WO | WO 2012046362 | A1 | 4/2012 |

OTHER PUBLICATIONS

Shibata et al., "Electrochemical Synthesis of Urea at Gas-Diffusion Electrodes Part VI. Simultaneous Reduction of Carbon Dioxide and Nitrite Ions with Various Metallophthalocyanine Catalysts". J. of Electroanalytical Chemistry (no month, 2001), vol. 507, pp. 177-184.

Jaaskelainen and Haukka, The Use of Carbon Dioxide in Ruthenium Carbonyl Catalyzed 1-hexene Hydroformylation Promoted by Alkali Metal and Alkaline Earth Salts, Applied Catalysis A: General, 247, 95-100 (2003).

Heldebrant et al., "Reversible Zwitterionic Liquids, The Reaction of Alkanol Guanidines, Alkanol Amidines, and Diamines wih CO2", Green Chem. (mo month, 2010), vol. 12, pp. 713-721.

Perez et al., "Activation of Carbon Dioxide by Bicyclic Amidines", J. Org. Chem. (no month, 2004), vol. 69, pp. 8005-8011.

Seshardi G., Lin C., Bocarsly A.B., A new homogeneous electrocatalyst for the reduction of carbon dioxide to methanol at low overpotential, Journal of Electroanalytical Chemistry, 1994, 372, pp. 145-150.

Eggins, Brown, McNeill, and Grimshaw, Carbon Dioxide Fixation by Electrochemical Reduction in Water to Oxalate and Glyoxylate, Tetrahedron Letters vol. 29, No. 8, pp. 945-948, 1988, Pergamon Journals Ltd., Printed in Great Britain.

M. Alvarez-Guerra et al., Conversion of carbon dioxide into formate using a continuous electrochemical reduction process in a lead cathode, Chem. Eng. J. (2012), http://dx.doi.org/10.1016/j.cej.2012.06.099.

Satoshi Kaneco, Kenji Iiba, Nobu-Hide Hiei, Kiyohisa Ohta, Takayuki Mizuno, and Tohru Suzuki, Electrochemical reduction of

(56) References Cited

OTHER PUBLICATIONS carbon dioxide to ethylene with high Faradaic efficiency at a Cu electrode in CsOH/methanol, Electrochimica Acta 44 (1999) 4701-4706.
Keith Scott, A Preliminary Investigation of the Simultaneous Anodic and Cathodic Production of Glyoxylic Acid, Electrochimica Acta, vol. 36, No. 9, pp. 1447-1452, 1991, Printed in Great Britain.
Seshadri et al., A New Homogeneous Electrocatalyst for the Reduction of Carbon Dioxide to Methanol at Low Overpotential, Journal of Electroanalytical Chemistry, 372 (1994), 145-50.
Green et al., Vapor-Liquid Equilibria of Formaldehyde-Methanol-Water, Industrial and Engineering Chemistry (Jan. 1955), vol. 47, No. 1, pp. 103-109.
Scibioh et al., Electrochemical Reduction of Carbon Dioxide: A Status Report, Proc Indian Natn Sci Acad (May 2004), vol. 70, A, No. 3, pp. 407-462.
Gennaro et al., Homogeneous Electron Transfer Catalysis of the Electrochemical Reduction of Carbon Dioxide. Do Aromatic Anion Radicals React in an Outer-Sphere Manner?, J. Am. Chem. Soc. (no month, 1996), vol. 118, pp. 7190-7196.
Perez et al., Activation of Carbon Dioxide by Bicyclic Amidines, J. Org. Chem. (no month, 2004), vol. 69, pp. 8005-8011.
Zaragoza Dorwald, Side Reactions in Organic Synthesis, 2005, Wiley-VCH Verlag GmbH & Co. KGaA, Weinheim, Preface. p. IX.
Liansheng et al, Journal of South Central University Technology, Electrode Selection of Electrolysis with Membrane for Sodium Tungstate Solution, 1999, 6(2), pp. 107-110.
Mahmood et al., Use of Gas-Diffusion Electrodes for High-Rate Electrochemical Reduction of Carbon Dioxide. II. Reduction at Metal Phthalocyanine-Impregnated Electrodes, J. of Appl. Electrochem. (no month, 1987), vol. 17, pp. 1223-1227.
Tanno et al., Electrolysis of Iodine Solution in a New Sodium Bicarbonate-Iodine Hybrid Cycle, International Journal of Hydrogen Energy (no month, 1984), vol. 9, No. 10, pp. 841-848.
B. Eneau-Innocent et al., Electroreduction of carbon dioxide at a lead electrode in propylene carbonate: A spectroscopic study, Applied Catalysis B: Environmental 98 (2010) 65-71.
Kotaro Ogura et al., Selective Conversion of CO2 to Ethylene by the Electrolysis at a Three-Phase (Gas/Liquid/Solid) Interface in an Acidic Solution Containing Cupric Ions, Fuel Chemistry Division Preprints 2003, 48(1), 264.
S. Gambino and G. Silvestri, On the electrochemical reduction of carbon dioxide and ethylene, Tetrahedron Letters No. 32, pp. 3025-3028, 1973, Pergamon Press, Printed in Great Britain.
K.S. Udupa, G.S. Subramanian, and H.V.K. Udupa, The electrolytic reduction of carbon dioxide to formic acid, Electrochimica Acta, 1971, vol. 16, pp. 1593 to 1598, Pergamon Press, Printed in Northern Ireland.
Seshadri et al, "A new homogeneous catalyst for the reduction of carbon dioxide to methanol at low overpotential," Journal of Electroanalytical Chemistry, 372 (1994) 145-150.
Scibioh et al, "Electrochemical Reductin of Carbon Dioxide: A Status Report," Proc. Indian Natn Science Acad., 70, A, No. 3, May 2004, pp. 407-762.
Fukaya et al., "Electrochemical Reduction of Carbon Dioxide to Formate Catalyzed by Rh(bpy)3Cl3", Kagaku Gijutsu Kenkyusho Hokoku (no month, 1986), vol. 81, No. 5, pp. 255-258. 1-page abstract only.
Li et al., "The Electro-Reduction of Carbon Dioxide in a Continuous Reactor", J. of Applied Electrochemistry (no month, 2005), vol. 35, pp. 955-965.
Kaneco et al., "Electrochemical Reduction of Carbon Dioxide to Ethylene with High Faradaic Efficiency at a Cu Electrode in CsOH/Methanol", Electrochimica Acta (no month, 1999), vol. 44, pp. 4701-4706.
Kaneco et al., "Electrochemical Conversion of Carbon Dioxide to Formic Acid on Pb in KOH/Methanol Electrolyte at Ambient Temperature and Pressure", Energy (no month, 1998), vol. 23, No. 12, pp. 1107-1112.
Yuan et al., "Electrochemical Activation of Carbon Dioxide for Synthesis of Dimethyl Carbonate in an Ionic Liquid", Electrochimica Acta (no month, 2009), vol. 54, pp. 2912-2915.
U.S. Appl. No. 13/724,647, filed Dec. 21, 2012; Office Action mailed Oct. 17, 2013.
U.S. Appl. No. 13/787,481, filed Mar. 6, 2013; Office Action mailed Sep. 13, 2013.
U.S. Appl. No. 13,724,082, filed Dec. 21, 2012; Office Action mailed Aug. 12, 2013.
U.S. Appl. No. 13/724,522, filed Dec. 21, 2012; Office Action mailed Oct. 1, 2013.
U.S. Appl. No. 13/724,885, filed Dec. 21, 2012; Office Action mailed Aug. 21, 2013.
U.S. Appl. No. 13/724,231, filed Dec. 21, 2012; Office Action mailed Aug. 20, 2013.
Seshadri et al., "A new homogeneous electrocatalyst for the reduction of carbon dioxide to methanol at low overpotential", Journal of Electroanalytical Chemistry and Interfacial Electro Chemistry, Elsevier, Amsterdam, NL, vol. 372, No. 1-2, Jul. 8, 1994, pp. 145-150.
Hossain et al., "Palladium and cobalt complexes of substituted quinoline, bipyridine and phenanthroline as catalysts for electrochemical reduction of carbon dioxide", Electrochimica Acta, Elsevier Science Publishers, vol. 42, No. 16, Jan. 1, 1997, pp. 2577-2585.
Fisher et al., "Electrocatalytic reduction of carbon dioxide by using macrocycles of nickel and cobalt", Journal of the American Chemical Society, vol. 102, No. 24, Sep. 1, 1980, pp. 7361-7363.
Ishida et al., Selective Formation of HC00—in the Electrochemical CO2 Reduction Catalyzed by URU(BPY)2(CO)2 3/4 2+ (BPY = 2,2'-Bipyridine), Journal of the Chemical Society, Chemical Communications, Chemical Society, Letchworth, GB, Jan. 1, 1987, pp. 131-132.
Zhao et al., "Electrochemical reduction of supercritical carbon dioxide in ionic liquid 1-n-butyl-3-methylimidazolium hexafluorophosphate", Journal of Supercritical Fluids, PRA Press, US, vol. 32, No. 1-3, Dec. 1, 2004, pp. 287-291.

* cited by examiner

MULTIPHASE ELECTROCHEMICAL REDUCTION OF $CO_2$

CROSS-REFERENCE TO RELATED APPLICATION

The present application claims the benefit under 35 U.S.C. §119(e) of U.S. Provisional Application Ser. No. 61/701,358 filed Sep. 14, 2012 which is incorporated by reference in its entirety.

The present application claims further claims the benefit under 35 U.S.C. §119(e) of U.S. Provisional Application Ser. No. 61/720,670 filed Oct. 31, 2012, U.S. Provisional Application Ser. No. 61/703,229 filed Sep. 19, 2012, U.S. Provisional Application Ser. No. 61/703,158 filed Sep. 19, 2012, U.S. Provisional Application Ser. No. 61/703,175 filed Sep. 19, 2012, U.S. Provisional Application Ser. No. 61/703,231 filed Sep. 19, 2012, U.S. Provisional Application Ser. No. 61/703,232 filed Sep. 19, 2012, U.S. Provisional Application Ser. No. 61/703,234 filed Sep. 19, 2012, U.S. Provisional Application Ser. No. 61/703,238 filed Sep. 19, 2012, U.S. Provisional Application Ser. No. 61/703,187 filed Sep. 19, 2012 and U.S. Provisional Application Ser. No. 61/675,938 filed Jul. 26, 2012. The U.S. Provisional Application Ser. No. 61/720,670 filed Oct. 31, 2012, U.S. Provisional Application Ser. No. 61/703,229 filed Sep. 19, 2012, U.S. Provisional Application Ser. No. 61/703,158 filed Sep. 19, 2012, U.S. Provisional Application Ser. No. 61/703,175 filed Sep. 19, 2012, U.S. Provisional Application Ser. No. 61/703,231 filed Sep. 19, 2012, U.S. Provisional Application Ser. No. 61/703, 232 filed Sep. 19, 2012, U.S. Provisional Application Ser. No. 61/703,234 filed Sep. 19, 2012, U.S. Provisional Application Ser. No. 61/703,238 filed Sep. 19, 2012, U.S. Provisional Application Ser. No. 61/703,187 filed Sep. 19, 2012 and U.S. Provisional Application Ser. No. 61/675,938 filed Jul. 26, 2012 are hereby incorporated by reference in their entireties.

CROSS REFERENCE TO RELATED APPLICATIONS

The present application incorporates by reference co-pending U.S. patent application Ser. No. 13/724,339 filed on Dec. 21, 2012, U.S. patent application Ser. No. 13/724,878 filed on Dec. 21, 2012, U.S. patent application Ser. No. 13/724,647 filed on Dec. 21, 2012, U.S. patent application Ser. No. 13/724,231 filed on Dec. 21, 2012, U.S. patent application Ser. No. 13/724,807 filed Dec. 21, 2012, U.S. patent application Ser. No. 13/724,996 filed on Dec. 21, 2012, U.S. patent application Ser. No. 13/724,719 filed on Dec. 21, 2012, and U.S. patent application Ser. No. 13/724,082 filed on Dec. 21, 2012, and U.S. patent application Ser. No. 13/724,768 filed on Dec. 21, 2012, now U.S. Pat. No. 8,444,844 in their entireties.

FIELD OF THE INVENTION

The present invention is directed to the use of both the cathode and anode regions of an electrochemical cell to produce useful chemicals.

BACKGROUND OF THE INVENTION

Electrochemical reduction of carbon dioxide is an important mechanism for converting carbon dioxide from waste sources into valuable chemicals.

SUMMARY OF THE PREFERRED EMBODIMENTS

The present invention is directed to employing the cathode and anode regions of an electrochemical cell to produce valuable chemicals. In one preferred embodiment of the present invention, a system for reducing carbon dioxide into a carbon based product is provided. The system includes an electrochemical cell having a cathode region which includes a cathode and a non-aqueous catholyte; an anode region having an anode and an aqueous or gaseous anolyte; and an ion permeable zone disposed between the anode region and the cathode region. The ion permeable zone is at least one of (i) the interface between the anolyte and the catholyte, (ii) an ion selective membrane; (iii) at least one liquid layer formed of an emulsion or (iv) a hydrophobic or glass fiber separator. The system also includes a source of carbon dioxide, the cell being configured to add the carbon dioxide to the cathode region. The system further includes a source of at least one electrolyte, the cell being configured to add the electrolyte to the anode and cathode regions. The electrolyte may be at least one selected from: an alkali metal salt, an alkaline earth salt; an onium salt, an aromatic or alkyl amine, a primary, secondary or tertiary amine salt, or a hydrogen halide. The system also includes at least one oxidizable anodic reactant, the cell being configured to add the oxidizable anodic reactant into the anode region. Further, the system includes at least one phase transfer agent, the cell being configured to add the phase transfer agent into at least one of the anode region and the cathode region. Still further, the system includes a source of energy, whereby applying the source of energy across the anode and cathode reduces the carbon dioxide and produces an oxidation product.

In another preferred embodiment of the present invention, a method for co-producing a reduction product from carbon dioxide and an oxidation product from an anodic reactant is provided. The method includes the steps of providing an electrochemical cell having a cathode region, an anode region and an ion permeable zone disposed between the anode region and the cathode region; adding a non-aqueous catholyte to the cathode region; adding an aqueous or gaseous anolyte to the anode region; adding carbon dioxide to the cathode region; adding an oxidizable anodic reactant to the anode region, adding an electrolyte to the anode and cathode regions, the electrolyte being at least one selected from: an alkali metal salt, an alkaline earth salt; an onium salt, an aromatic or alkyl amine, a primary, secondary or tertiary amine salt, or a hydrogen halide; adding a phase transfer agent into at least one of the anode region and the cathode region; and applying a source of energy across the anode and cathode to reduce the carbon dioxide and produce an oxidation product from the anodic reactant.

In yet another preferred embodiment of the present invention, disclosed is a method for electrochemically producing a carbon dioxide reduction product and an oxidation product in an electrochemical cell having an anode region that includes an anode and a cathode region that includes a cathode. The method comprises the steps of adding a substantially water free solvent to the cathode region; adding an aqueous solvent to the anode region; separating the regions by an ion transport zone; adding carbon dioxide to the cathode region; adding an anodic reactant to the anode region; adding a phase transfer agent to one or more of the regions to thereby selectively transport ions from one region to the other region through the ion transport zone; applying a current across the anode and cathode; and transporting a carbon dioxide product and an oxidation product from the cell for further processing.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure.

BRIEF DESCRIPTION OF THE DRAWINGS

The numerous advantages of the present disclosure may be better understood by those skilled in the art by reference to the accompanying figures in which.

DETAILED DESCRIPTION OF THE PREFERRED EMBODIMENTS

Figure 1:
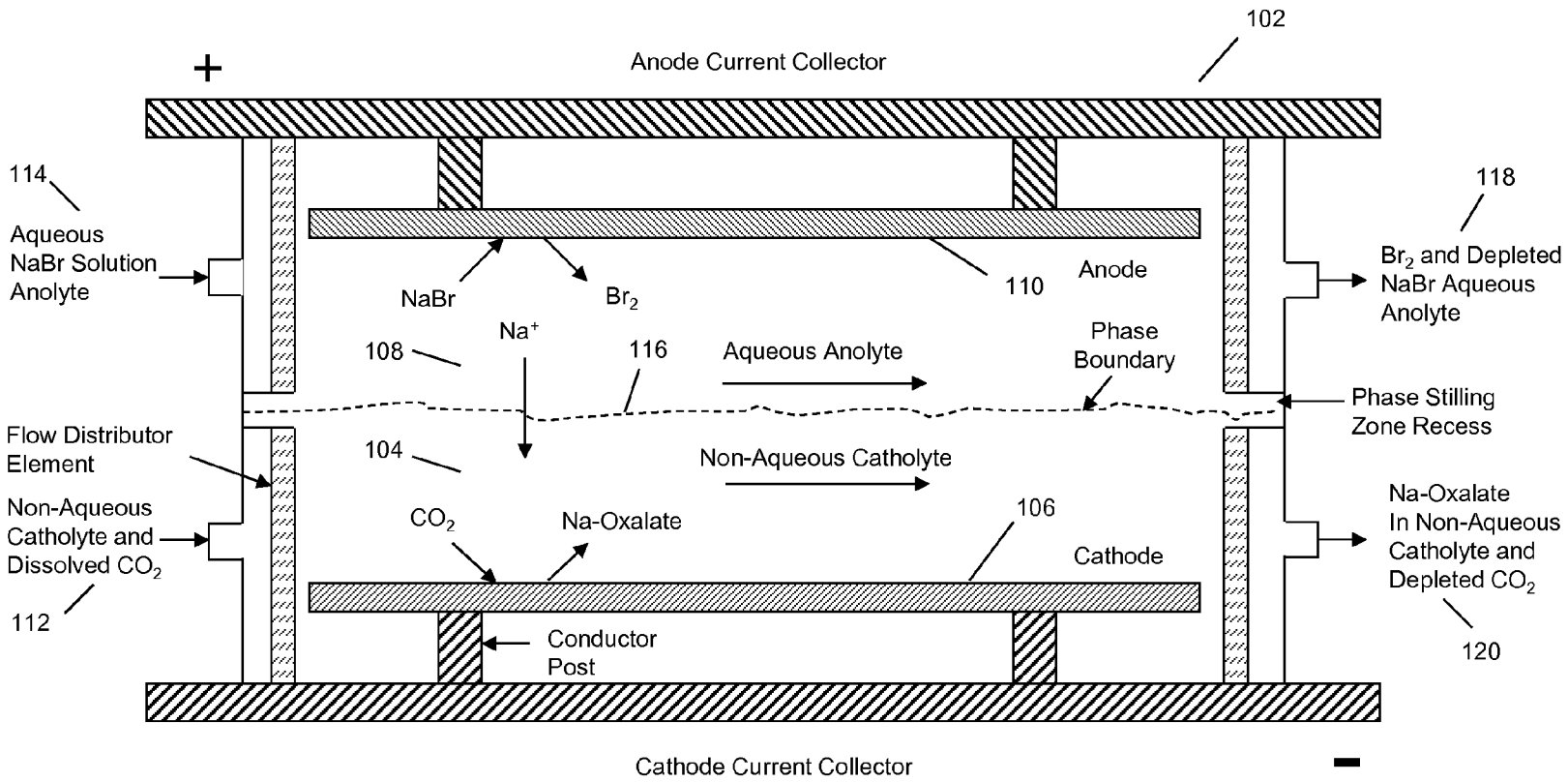
FIG. 1 is a diagram of a system in accordance with a preferred embodiment of the present invention where the cell is horizontal and no separator is employed.

Reference will now be made in detail to the subject matter disclosed. The present invention in general shall be described followed by a preferred example as referenced in detail in the drawings.

General Description

Before any embodiments of the disclosure are explained in detail, it is to be understood that the embodiments may not be limited in application per the details of the structure or the function as set forth in the following descriptions or illustrated in the figures. Different embodiments may be capable of being practiced or carried out in various ways. Also, it is to be understood that the phraseology and terminology used herein is for the purpose of description and should not be regarded as limiting. The use of terms such as "including," "comprising," or "having" and variations thereof herein are generally meant to encompass the item listed thereafter and equivalents thereof as well as additional items. Further, unless otherwise noted, technical terms may be used according to conventional usage. It is further contemplated that like reference numbers may describe similar components and the equivalents thereof.

Figure 2:
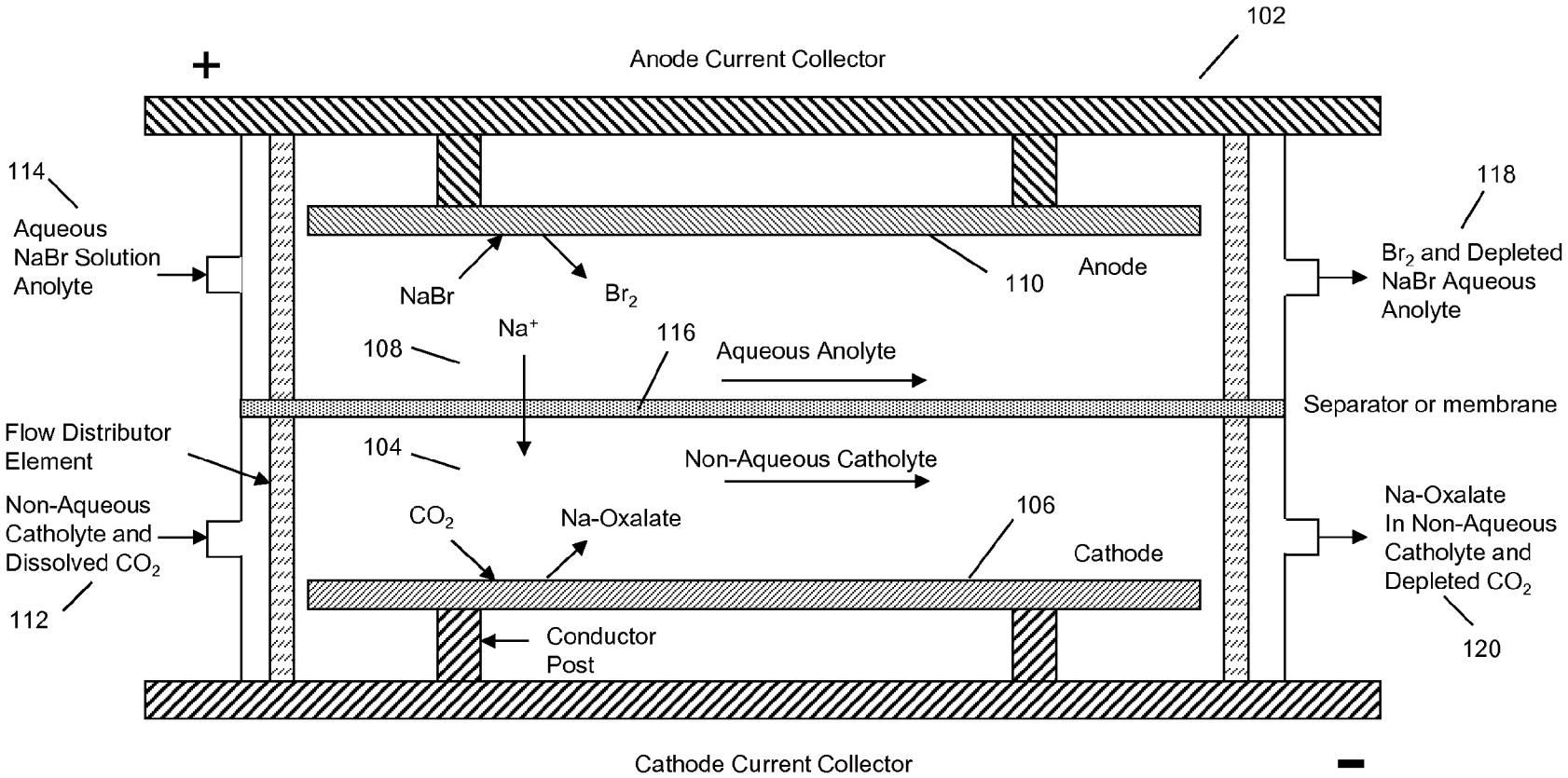
FIG. 2 is a diagram of a system in accordance with another preferred embodiment of the present invention where the cell is horizontal and a separator is employed.

Referring generally to FIGS. 1 and 2, systems and methods of electrochemical co-production of products are disclosed. It is contemplated that the electrochemical co-production of products may include a production of a first product, such as reduction of carbon dioxide to a carbon-based product at a cathode side of an electrochemical cell with co-production of an oxidized product at the anode side of the electrochemical cell.

Referring to FIGS. 1 and 2, there is shown generally a system for reducing carbon dioxide to a carbon based product. The system preferably includes divided electrochemical cell 102 which includes cathode region 104 having cathode 106 and anode region 108 having anode 110. The divided electrochemical cell 102 may be a divided electrochemical cell and/or a divided photochemical cell. The electrochemical cell may have regions also referred to as reaction zones or more confined compartments if physical separators or membranes are employed to separate the regions.

The inventive system includes an input feed 112 of a non-aqueous catholyte having carbon dioxide dissolved therein into cathode region and an input feed 114 of an aqueous anolyte into the anode region. Alternatively, the carbon dioxide and the catholyte can be separately fed into the cathode region. Preferably during operation of the system of the present invention, the cathode region is substantially if not exclusively consisting of a non-aqueous catholyte and the anode region is substantially if not exclusively consisting of an aqueous anolyte or a gaseous anolyte.

Throughout the specification the term "add" is employed to describe supplying a moiety to the cell. This term is intended in the broadest sense to include directly or indirectly supplying the moiety or a precursor to the moiety, and flowing the moiety or precursor to the moiety directly or indirectly into the cell.

In general the anolyte is a water based solvent, preferably water. The anolyte may further include one or more of metal nanoparticles, zwitterions, reverse micelles and ionic liquids.

As an alternative to a liquid anolyte, an anolyte consisting of a gas may be fed into the anolyte region. In such case the anode region during operation of the cell is heated to above about 60° C., with the specific temperature depending upon the vaporization temperature of the anolyte. The gas is preferably one of a hydrogen halide and water. Preferably the oxidation product is at least one of a halogen or $O_2$, and the halogen is preferably at least one of bromine and chlorine.

The catholyte may include one or more of propylene carbonate, ethylene carbonate, dimethyl carbonate, diethyl carbonate, dimethylsulfoxide, dimethylformamide, acetonitrile, acetone, tetrahydrofurane, N,N-dimethylacetaminde, dimethoxyethane, polyols comprising glycols, dimethyl ester, butyrolnitrile, 1,2-difluorobenzene, γ-butyrolactone, N-methyl-2-pyrrolidone, sulfolane, nitrobenzene, nitromethane, acetic anhydride, ionic liquids comprising pyridinium and imidazolium groups, alkanes comprising hexanes, heptanes, octane and kerosene, perfluorocarbons comprising perflurohexane, chlorofluorocarbons, freon, halon, linear carbonates comprising diethyl carbonate, aromatics comprising benzene, toluene, trifluro toluene, chlorobenzene and m-cresol, dichloromethane, chloroform, $CCl_4$, ethers comprising diethyl ether, dipropyl ether, mixed alkyl ethers, polyethers, and anisole, 1,4-dioxane, glymes comprising glymes, diglymes, triglymes and glyme derivatives, alcohols comprising 1-octanol, 1-hexanol, and cyclohexanol, alkenes comprising 1-octene. More preferably the catholyte is propylene carbonate. Preferably non-aqueous solvents are substantially water free and more preferably at least 99% by volume water free and even more preferably dry.

The catholyte may include an additive selected from the group consisting of (a) alkyl carbonates comprising ethyl methyl carbonate, dipropyl carbonate, dibutyl carbonate and mixtures thereof, and (b) phosphates comprising benzyl phosphate, dibenzyl dimethyl phosphate, allyl phosphate, dibenzyl phosphate, diallyl phosphates and mixtures thereof, and (c) mixtures of (a) and (b). The catholyte may also include an anion acceptor selected from the group consisting of boranes and boroxine derivatives comprising tris(isopropyl) borane and trimethoxyboroxin, and mixtures thereof.

It is further contemplated that the structure and operation of the electrochemical cell may be adjusted to provide desired results. For example, the electrochemical cell may operate at higher pressures, such as pressure above atmospheric pressure which may increase current efficiency and allow operation of the electrochemical cell at higher current densities.

The catholyte and catalysts may be selected to prevent corrosion at the electrochemical cell 102. The catholyte may include homogeneous catalysts. Homogeneous catalysts are defined as aromatic heterocyclic amines and may include, but are not limited to, unsubstituted and substituted pyridines and imidazoles. Substituted pyridines and imidazoles may include, but are not limited to mono and disubstituted pyridines and imidazoles. For example, suitable catalysts may include straight chain or branched chain lower alkyl (e.g., Cl-C10) mono and disubstituted compounds such as 2-methylpyridine, 4-tertbutyl pyridine, 2,6 dimethylpyridine (2,6-lutidine); bipyridines, such as 4,4'-bipyridine; amino-substituted pyridines, such as 4-dimethylamino pyridine; and hydroxyl-substituted pyridines (e.g., 4-hydroxy-pyridine) and substituted or unsubstituted quinoline or isoquinolines. The catalysts may also suitably include substituted or unsubstituted dinitrogen heterocyclic amines, such as pyrazine, pyridazine and pyrimidine. Other catalysts generally include azoles, imidazoles, indoles, oxazoles, thiazoles, substituted species and complex multi-ring amines such as adenine, pterin, pteridine, benzimidazole, phenonthroline and the like.

The catholyte may include an electrolyte. Catholyte electrolytes may include alkali metal bicarbonates, carbonates, sulfates, phosphates, borates, and hydroxides. The electrolyte may comprise one or more of $Na_2SO_4$, KCl, $NaNO_3$, NaCl, NaF, $NaClO_4$, $KClO_4$, $K_2SiO_3$, $CaCl_2$, a guanidinium cation, an H cation, an alkali metal cation, an ammonium cation, an alkylammonium cation, a tetraalkyl ammonium cation, a halide anion, an alkyl amine, a borate, a carbonate, a guanidinium derivative, a nitrite, a nitrate, a phosphate, a polyphosphate, a perchlorate, a silicate, a sulfate, and a hydroxide. In one embodiment, bromide salts such as NaBr or KBr may be preferred.

Catholyte may be operated at a temperature range of −10 to 95° C., more preferably 5-60° C. The lower temperature will be limited by the catholytes used and their freezing points. In general, the lower the temperature, the higher the solubility of $CO_2$, which would help in obtaining higher conversion and current efficiencies. The drawback is that the operating electrochemical cell voltages may be higher, so there is an optimization that would be done to produce the chemicals at the lowest operating cost. In addition, the catholyte may require cooling, so an external heat exchanger may be employed, flowing a portion, or all, of the catholyte through the heat exchanger and using cooling water to remove the heat and control the catholyte temperature.

With reference to FIG. 1, the ion permeable zone 116 between the anode region and the cathode region can be the interface or "phase stilling zone" between the anolyte and the catholyte. Alternatively, as shown in FIG. 2, the ion permeable zone 116 may be an ion selective membrane or a hydrophobic or glass fiber separator. Depending upon the anolyte and catholyte selected, the ion permeable zone may also be an emulsion layer formed between the anolyte and catholyte.

Preferably, the membrane 116 is at least one of a cation exchange membrane, an anion exchange membrane or a hydrophobic membrane. Cation ion exchange membranes which have a high rejection efficiency to anions may be preferred. Examples of such cation ion exchange membranes include perfluorinated sulfonic acid based ion exchange membranes such as DuPont Nafion® brand unreinforced types N117 and N120 series, more preferred PTFE fiber reinforced N324 and N424 types, and similar related membranes manufactured by Japanese companies under the supplier trade names such as Flemion®. Other multi-layer perfluorinated ion exchange membranes used in the chlor alkali industry may have a bilayer construction of a sulfonic acid based membrane layer bonded to a carboxylic acid based membrane layer. These membranes may have a higher anion rejection efficiency. These are sold by DuPont under the Nafion® trademark as the N900 series, such as the N90209, N966, N982, and the 2000 series, such as the N2010, N2020, and N2030 and all of their types and subtypes. Hydrocarbon based membranes, which are made from various cation ion exchange materials can also be used if anion rejection is not as desirable, such as those sold by Sybron under the trade name Ionac®, ACG Engineering (Asahi Glass) under the Selemion® trade name, and Tokuyama Soda. Ceramic based membranes may also be employed, including those that are marketed under the general name of NASICON (for sodium super-ionic conductors). These, the composition of which is $Na_1{}^+{}_xZr_2Si_xP_3\text{-}xO_{12}$, are chemically stable over a wide pH range for various chemicals and selectively transport sodium ions. Ceramic based conductive membranes based on titanium oxides, zirconium oxides and yttrium oxides, and beta aluminum oxides, may also be employed.

Separator 116, also referred to as a membrane, between a first region and second region, may include cation ion exchange type membranes. Cation ion exchange membranes which have a high rejection efficiency to anions may be preferred. Examples of such cation ion exchange membranes may include perfluorinated sulfonic acid based ion exchange membranes such as DuPont Nafion® brand unreinforced types N117 and N120 series, more preferred PTFE fiber reinforced N324 and N424 types, and similar related membranes manufactured by Japanese companies under the supplier trade names such as AGC Engineering (Asahi Glass) under their trade name Flemion®. Other multi-layer perfluorinated ion exchange membranes used in the chlor alkali industry may have a bilayer construction of a sulfonic acid based membrane layer bonded to a carboxylic acid based membrane layer, which efficiently operates with an anolyte and catholyte above a pH of about 2 or higher. These membranes may have a higher anion rejection efficiency. These are sold by DuPont under their Nafion® trademark as the N900 series, such as the N90209, N966, N982, and the 2000 series, such as the N2010, N2020, and N2030 and all of their types and subtypes. Hydrocarbon based membranes, which are made from of various cation ion exchange materials can also be used if the anion rejection is not as desirable, such as those sold by Sybron under their trade name Ionac®, AGC Engineering (Asahi Glass) under their Selemion® trade name, and Tokuyama Soda, among others on the market. Ceramic based membranes may also be employed, including those that are called under the general name of NASICON (for sodium super-ionic conductors) which are chemically stable over a wide pH range for various chemicals and selectively transports sodium ions, the composition is $Na_1{}^+xZr_2SixP_3{}^-xO_{12}$, and well as other ceramic based conductive membranes based on titanium oxides, zirconium oxides and yttrium oxides, and beta aluminum oxides. Alternative membranes that may be used are those with different structural backbones such as polyphosphazene and sulfonated polyphosphazene membranes in addition to crown ether based membranes. Preferably, the membrane or separator is chemically resistant to the anolyte and catholyte and operates at temperatures of less than 600° C., and more preferably less than 500° C.

The electrochemical cell 102 is configured to feed at least one electrolyte into at least one of the anode and cathode regions. In typical processes, the electrolyte is non reactive in nature but needed for the charge neutrality/balancing of the process during reduction and oxidation (redox) reactions which occur at cathode and anode respectively. However, in the present invention, an inorganic electrolyte is selected to be reactive in nature, for example, at the anode:

$$2NaBr \rightarrow Br_2 + 2Na^+ + 2e^-$$

The cations which are unreactive in the anodic region will migrate through the ion permeable zone to the cathode region to facilitate the formation of oxalate anions at the cathode:

$$2CO_2 + 2Na{+}{+} 2e- \rightarrow Na_2(COO)_2$$

The solubility of NaBr and migration of Na+ ions in aqueous electrochemical systems is well documented. However, similar reactions in non aqueous solvents generally do not occur with common inexpensive salts such as NaBr, KBr, KCl, NaF, NaCl, and KI as such salts are not readily soluble in non aqueous solvents. Typically, bulky tetra alkyl quaternary ammonium salts are used as electrolytes in non-aqueous systems for the conversion of $CO_2$ to oxalate product due to their solubility therein. The present invention includes a phase transfer agent such as a crown ether whereby an inexpensive salt may be used as an electrolyte and anodic reactant and whereby the phase transfer agent facilitates transferring the salt cation into a non aqueous region where carbon dioxide is dissolved and is reduced to preferably oxalate.

In general, the electrolyte may be at least one selected from: an alkali metal salt, an alkaline earth salt; an onium salt, an aromatic or alkyl amine, a primary, secondary or tertiary amine salt, or a hydrogen halide. If electrolytes are fed into both the anode and cathode regions, the electrolyte fed into the anode region may be different from the electrolyte fed into the cathode region. Preferably the electrolyte fed into the anode region is MX, where M is selected from the group consisting of cations of Na, K, Li, Cs, Rb, Be, Mg, Ca, Ba, tetraalkylammonium and pyridinium, and X is selected from the group consisting of anions of Cl, Br, F, and I. Even more preferably, the electrolyte fed into the anode region is at least one of MBr and MCl.

In addition, an oxidizable anodic reactant may be added to the anode region. In general, the oxidizable anodic reactant may be any chemical moiety which can be oxidized in the anode region, organic or inorganic. Preferably the oxidizable anodic reactant is a compound having an oxygen, nitrogen or halide atom where the compound can be oxidized in the anode region. More preferably, the oxidizable anodic reactant may be selected from MX or RX, where R is hydrogen cation or a C1 to C4 alkyl or aryl or heteroaryl radical, and X is selected from the group consisting of anions of Cl, Br, F, and I. The oxidizable anodic reactant may be added directly to the cell or be added to the input flow of the anolyte.

The electrochemical cell 102 is further configured to feed a phase transfer agent into at least one of the anode region and the cathode region. The phase transfer agent may be selected based upon the electrolyte selected. The phase transfer agent can be added to the input flow of either the anolyte or the catholyte, or be separately fed into the anode and/or cathode regions. The electrolyte and the phase transfer agent may both be quaternary ammonium salts.

In a preferred embodiment, the onium salt is a quaternary salt. The quaternary salt may be at least one of tetrabutylammonium bromide (TBABr), TMACl, $Hex_4NBr$, $Oct_4NBr$, cetyltrimethylammonium bromide (CTAB), hexadecyltributyl phosphonium bromide, Starks' catalyst, and $R_1R_2R_3R_4AX$, where $R_1$ to $R_4$ are independently alkyl, branched alkyl, cyclo alkyl, and aryl; A is selected from the group consisting of N, P, As, Sb and Bi, and X is selected from the group consisting of F, Cl, Br and I.

Preferably, the phase transfer agent is at least one of crown ethers, substituted crown ethers, metallo crowns, onium salts comprising quaternary ammonium salts, quaternary phosphonium salts, quaternary arsonium salts, quaternary stibonium salts, quaternary bismuthonium salts comprising uniform or mixed alkyl or aryl or cyclic or heterocyclic chains, tetrabutylammonium bromide(TBABr), tetramethylammonium chloride (TMACl), cetyltrimethylammonium bromide (CTAB), Stark's catalyst/Aliquat 336, surfactants with pyridine head groups, cryptands, azaethers, polyol or poly ethers, glycols comprising polyethylene glycol, glymes, diglymes, triglymes, tetraglymes, other glyme variations, and mixtures thereof.

Preferable crown ethers include at least one of 12-Crown-4, 15-Crown-5, 18-Crown-6, and Dibenzo-18-Crown-6. The presence of crown ether enhances the solubility of metal halides in the non aqueous catholyte, the rate of metal cation transfer to the cathode region, and enhances the kinetics of halide anion oxidation to a halogen. The crown ether is selected based upon the cation to be transferred across the ion permeable zone. The crown ethers selectively bind to specific cations depending on the interior size of the ring which is comparable to the size of the cations. Hence, 18-Crown-6, 15-Crown-5 and 12-Crown-4 bind to K+, Na+ and Li+ ions, respectively. Similarly, several substituents on the carbon atom of the ring dictates the strength and specificity of interaction with cations.

In general, either a crown ether, substituted crown ether or a cryptand is selected if the cation transfer across the ion permeable zone is to be selective, and a glyme, diglyme, triglyme, tetraglyme, and other glyme variation, is selected if cation transfer is not selective. In addition, the phase transfer agent should be selected to lessen the drag of water into the cathode region.

The electrochemical cell is generally operational to reduce carbon dioxide in the cathode region to a first product recoverable from the first region while producing an oxidation product recoverable from the anode region. The cathode may reduce the carbon dioxide into a first product that may include one or more compounds including CO, formic acid, formaldehyde, methanol, oxalate, oxalic acid, glyoxylic acid, glycolic acid, glyoxal, glycolaldehyde, ethylene glycol, acetic acid, acetaldehyde, ethanol, lactic acid, propane, propanoic acid, acetone, isopropanol, 1-propanol, 1,2-propylene glycol, butane, butane, 1-butanol, 2-butanol, an alcohol, an aldehyde, a ketone, a carboxylate, and a carboxylic acid, preferably oxalate or oxalic acid. Preferably a product extractor (not shown) is employed to extract the selected reduction product from the catholyte output flow 120 and the selected oxidation product from the anolyte output flow 118. In a preferable embodiment, the carbon dioxide reduction product is an oxalate salt, and the oxidation product is $X_2$, where X is at least one of Br or Cl.

The electrochemical cell 102 further includes a source of energy (not shown) which is applied across the anode and cathode. The energy source may generate an electrical potential between the anode 110 and the cathode 106. The electrical potential may be a DC voltage. The energy source may be configured to implement a variable voltage source.

The anolyte output flow 118 may contain the oxidation product, depleted electrolyte, depleted oxidizable anodic reactant and the aqueous anolyte. The catholyte output flow 120 may contain the reduction product, depleted carbon dioxide and non aqueous catholyte. The outputs may be designed to transport the carbon dioxide reduction product and the anode oxidation product to a region outside of the cell for storage, further processing or recycling. The system may be provided with separators to separate the component parts of the outputs, and recycle them back into the cell following appropriate processing whether by extraction, drying, ion separation, or further chemical conversion.

For example, the system may further include a water/non-aqueous separator (not shown), wherein the electrochemical cell 102 is configured to transport a mixture of non-aqueous solvent and water to the water/non-aqueous separator to thereby produce non-aqueous solvent substantially free of water, and wherein the non-aqueous solvent produced is recycled back into the electrochemical cell 102. The system can also include an oxalate/non-aqueous separator (not shown), wherein the electrochemical cell 102 is configured to transport a mixture of non-aqueous solvent and oxalate to the oxalate/non-aqueous separator to thereby produce oxalate and non-aqueous solvent. In such case, the system can also include a dryer (not shown) to dry the non-aqueous solvent, wherein the non-aqueous solvent resulting for the separation in the oxalate/non-aqueous separator can be dried and recycled back into the cell.

The system can be either horizontally or vertically configured for solvent flow through. In addition, the system can be configured so that the solvent flow through the anode region is counter to the solvent flow through the cathode region.

In another embodiment of the present invention, the cell may be configured to include a feed of a carbon based organic compound into the anode region. The feed can separately flow into the anode region or can be fed into the anode region along with the anolyte input 114. Preferably, the carbon based organic compound is selected from the group consisting of alkanes, alkenes, ethylene, alkynes, ethyne, aryls, benzene, toluene, xylene and mixtures thereof, and more preferably ethane. Alternatively, the carbon based organic compound may be halogenated. The anolyte output flow may include the oxidized carbon based product.

It is contemplated that the system may employ a series of cells and may include various mechanisms for producing product whether in a continuous, near continuous or batch portions.

It is further contemplated that the structure and operation of the electrochemical cell 102 may be adjusted to provide desired results. For example, the electrochemical cell 102 may operate at higher pressures, such as pressure above atmospheric pressure which may increase current efficiency and allow operation of the electrochemical cell 102 at higher current densities.

Additionally, the cathode 106 and anode 110 may include a high surface area with a void volume which may range from 30% to 98%. The surface area may be from 2 cm2/cm3 to 500 cm2/cm3 or higher. It is contemplated that surface areas also may be defined as a total area in comparison to the current distributor/conductor back plate, with a preferred range of 2× to 1000× or more.

Cathode 106 may be selected from a number of high surface area materials to include copper, stainless steels, transition metals and their alloys and oxides, carbon, conductive polymers, and silicon, which may be further coated with a layer of material which may be a conductive metal or semiconductor. The base structure of cathode may be in the form of fibrous, reticulated, or sintered powder materials made from metals, carbon, or other conductive materials including polymers. The materials may be a very thin plastic screen incorporated against the cathode side of the membrane to prevent the membrane from directly touching the high surface area cathode structure. The high surface area cathode structure may be mechanically pressed against a cathode current distributor backplate, which may be composed of material that has the same surface composition as the high surface area cathode.

Additionally, the cathode and anode may include a high surface area electrode structure with a void volume which may range from 30% to 98%. The electrode void volume percentage may refer to the percentage of empty space that the electrode is not occupying in the total volume space of the electrode. The advantage in using a high void volume electrode is that the structure has a lower pressure drop for liquid flow through the structure. The specific surface area of the electrode base structure may be from 2 cm2/cm3 to 500 cm2/cm3 or higher. The electrode specific surface area is a ratio of the base electrode structure surface area divided by the total physical volume of the entire electrode. It is contemplated that surface areas also may be defined as a total area of the electrode base substrate in comparison to the projected geometric area of the current distributor/conductor back plate, with a preferred range of 2× to 1000× or more. The actual total active surface area of the electrode structure is a function of the properties of the electrode catalyst deposited on the physical electrode structure which may be 2 to 1000 times higher in surface area than the physical electrode base structure.

In addition, the cathode may be a suitable conductive electrode, such as Al, Au, Ag, Bi, C, Cd, Co, Cr, Cu, Cu alloys (e.g., brass and bronze), Ga, Hg, In, Mo, Nb, Ni, $NiCo_2O_4$, Ni alloys (e.g., Ni 625, NiHX), Ni—Fe alloys, Pb, Pd alloys (e.g., PdAg), Pt, Pt alloys (e.g., PtRh), Rh, Sn, Sn alloys (e.g., SnAg, SnPb, SnSb), Ti, V, W, Zn, stainless steel (SS) (e.g., SS 2205, SS 304, SS 316, SS 321), austenitic steel, ferritic steel, duplex steel, martensitic steel, Nichrome (e.g., NiCr 60:16 (with Fe)), elgiloy (e.g., Co—Ni—Cr), degenerately doped p-Si, degenerately doped p-Si:As, degenerately doped p-Si:B, degenerately doped n-Si, degenerately doped n-Si:As, degenerately doped n-Si:B and conductive polymers. These metals and their alloys may also be used as catalytic coatings on the various metal substrates. Other conductive electrodes may be implemented to meet the criteria of a particular application. For photoelectrochemical reductions, cathode 122 may be a p-type semiconductor electrode, such as p-GaAs, p-GaP, p-InN, p-InP, p-CdTe, p-$GaInP_2$ and p-Si, or an n-type semiconductor, such as n-GaAs, n-GaP, n-InN, n-InP, n-CdTe, n-$GaInP_2$ and n-Si. Other semiconductor electrodes may be implemented to meet the criteria of a particular application including, but not limited to, CoS, $MoS_2$, TiB, $WS_2$, SnS, $Ag_2S$, $CoP_2$, $Fe_3P$, $Mn_3P_2$, MoP, $Ni_2Si$, $MoSi_2$, WSi2, $CoSi_2$, $Ti_4O_7$, $SnO_2$, GaAs, GaSb, Ge, and CdSe.

Preferably, the catholyte and catalysts may be selected to prevent corrosion at the electrochemical cell. The catholyte may include homogeneous catalysts such as pyridine, 2-picoline, and the like.

In one embodiment, a catholyte/anolyte flow rate may include a catholyte/anolyte cross sectional area flow rate range such as 2-3,000 gpm/$ft^2$ or more (0.0076-11.36 $m^3/m^2$). A flow velocity range may be 0.002 to 20 ft/sec (0.0006 to 6.1 m/sec). Operation of the catholyte at a higher operating pressure allows more carbon dioxide to dissolve in the aqueous electrolyte. Typically, electrochemical cells can operate at pressures up to about 20 to 30 psig in multi-cell stack designs, although with modifications, electrochemical cells may operate at up to 100 psig. The electrochemical cell 102 may operate the anolyte at the same pressure range to minimize the pressure differential on a separator or membrane separating the two compartments. Special electrochemical designs may be employed to operate electrochemical units at higher operating pressures up to about 60 to 100 atmospheres or greater, which is in the liquid $CO_2$ and supercritical $CO_2$ operating range.

In another embodiment, a portion of a catholyte recycle stream may be separately pressurized using a flow restriction with backpressure or using a pump, with $CO_2$ injection, such that the pressurized stream is then injected into the catholyte region of the electrochemical cell which may increase the amount of dissolved $CO_2$ in the aqueous solution to improve the conversion yield.

The catholyte may be operated at a temperature range of −10 to 95° C., more preferably 5-60° C. The lower temperature will be limited to the electrolytes used and their freezing points. In general, the lower the temperature, the higher the solubility of $CO_2$, thereby facilitating obtaining higher conversion and current efficiencies. The drawback is that the operating electrochemical cell voltages may be higher, so there is an optimization that would be done to produce the chemicals at the lowest operating cost. Anolyte operating temperatures may be in the same ranges as the ranges for the catholyte, and may be in a range of 0° C. to 95° C. or higher in the case of gaseous anolytes.

Electrochemical cells may include various types of designs. These designs may include Zero Gap, flow-through with a recirculating catholyte electrolyte with various high surface area cathode materials. The electrochemical cell 102 may include flooded co-current packed and trickle bed designs with the various high surface area cathode materials. Also, bipolar stack cell designs and high pressure cell designs may also be employed for the electrochemical cells.

Commonly used cathodes are Pb, Pb alloys, SS304, SS316, and transition metal alloys including Fe—Cr alloys. The cathode construction can use a flat plate for the current collector/distributor, and employ a high surface area structure for the cathode reaction, using for example, structures in the form of metal felts, consisting of both woven and sintered metal fibers, forms made from sintered metal powders, and metal reticulated forms. The high surface area forms may be sintered or bonded to the current distributor to obtain the best electrical contact.

Anodes include DSA® type anodes, such as titanium or niobium, and may also include graphite or carbon. The anodes may also include coatings on the metal substrate or polymer or conducting polymer. For example, for HBr, acid anolytes and oxidizing water generating oxygen, the preferred electrocatalytic coatings may include precious metal oxides such as ruthenium and iridium oxides, as well as platinum and gold and their combinations as metals and oxides on valve metal substrates such as titanium, tantalum, or niobium. For bromine and iodine anode chemistry, carbon and graphite are particularly suitable for use as anodes. Polymeric bonded carbon sheets are now readily available, such as found in the Graphite Store. For other anolytes such as alkaline or hydroxide electrolytes, anodes may include carbon, cobalt oxides, stainless steels, and their alloys and combinations. The anode can consist of a current collector plate form and incorporate a high surface area material in the form of a felt or woven material.

Anode electrodes may be the same as cathode electrodes or different. Anode 110 may include electrocatalytic coatings applied to the surfaces of the base anode structure. Anolytes may be the same as catholytes or different. Anolyte electrolytes may be the same as catholyte electrolytes or different. Anolyte may comprise solvent. Anolyte solvent may be the same as catholyte solvent or different. For example, for HBr, acid anolytes, and oxidizing water generating oxygen, the preferred electrocatalytic coatings may include precious metal oxides such as ruthenium and iridium oxides, as well as platinum and gold and their combinations as metals and oxides on valve metal substrates such as titanium, tantalum, zirconium, or niobium. For bromine and iodine anode chemistry, carbon and graphite are particularly suitable for use as anodes. Polymeric bonded carbon material may also be used. For other anolytes, comprising alkaline or hydroxide electrolytes, anodes may include carbon, cobalt oxides, stainless steels, transition metals, and their alloys and combinations. High surface area anode structures that may be used which would help promote the reactions at the anode surfaces. The high surface area anode base material may be in a reticulated form composed of fibers, sintered powder, sintered screens, and the like, and may be sintered, welded, or mechanically connected to a current distributor back plate that is commonly used in bipolar electrochemical cell assemblies. In addition, the high surface area reticulated anode structure may also contain areas where additional applied catalysts on and near the electrocatalytic active surfaces of the anode surface structure to enhance and promote reactions that may occur in the bulk solution away from the anode surface such as the reaction between bromine and the carbon based reactant being introduced into the anolyte. The anode structure may be gradated, so that the density of the may vary in the vertical or horizontal direction to allow the easier escape of gases from the anode structure. In this gradation, there may be a distribution of particles of materials mixed in the anode structure that may contain catalysts, such as metal halide or metal oxide catalysts such as iron halides, zinc halides, aluminum halides, cobalt halides, for the reactions between the bromine and the carbon-based reactant. For other anolytes comprising alkaline, or hydroxide electrolytes, anodes may include carbon, cobalt oxides, stainless steels, and their alloys and combinations.

A Preferred Example

As shown in FIG. 2, utilizing propylene carbonate as a non aqueous electrolyte/solvent in the cathode region and using a sodium bromide (NaBr) aqueous electrolyte solution for the anode region, and one or more membranes or separators forming a central separation zone, bromine and oxalate may be electrochemically produced.

The anode reaction is the electrolysis of NaBr forming bromine gas or as a soluble hydrogen tribromide ($HBr_3$) complex. Optionally, a carbon based organic compound such as ethane gas may be injected into the anolyte stream to form a brominated organic, such as bromoethane.

In the reaction, the cation, in this example, sodium ions ($Na^+$), transport through the membrane/separator with the aid of the phase transfer catalyst. The preferred membrane for this example is a bromine oxidation resistant type, such as the perfluorinated sulfonic acid types produced by DuPont under the trade name Nafion, such as Nafion 324 and the like. The sodium ions also carry 3-4 moles or molecules of water per sodium ion, called electro-osmotic drag. The advantage with using bromine resistant cation exchange membranes is that they substantially reduce the transport of bromine and bromide ions from the aqueous anode region to the cathode region.

The cathode reaction is the reduction of carbon dioxide ($CO_2$) at the cathode, producing for example, Na-oxalate as the product, but other carbon reduction products are also suitable, and may be produced by using alternative non-aqueous electrolytes/solvents in these cell and process configurations. In this example, the cathode can consist of various metals that are suitable for the high efficiency conversion of $CO_2$ to oxalate, such as stainless steels, such as 304 and 316 stainless steel types, and other suitable metals and coatings on metal substrates.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. The methods disclosed may be implemented as sets of instructions. Further, it is understood that the specific order or hierarchy of steps in the methods disclosed are examples of exemplary approaches. Based upon design preferences, it is understood that the specific order or hierarchy of steps in the method can be rearranged while remaining within the disclosed subject matter.

We claim:

1. A method for co-producing a reduction product from carbon dioxide and an oxidation product, the method comprising the steps of:

a. providing an electrochemical cell comprising a cathode region comprising a cathode, an anode region comprising an anode and an ion permeable zone between the anode region and the cathode region;

b. adding a non-aqueous catholyte to the cathode region whereby the catholyte region is non-aqueous;

c. adding an aqueous or gaseous anolyte to the anode region whereby the anode region is either aqueous or gaseous and adding a carbon based organic compound to the anode region;

d. adding carbon dioxide to the cathode region;

e. adding an electrolyte to the anode and cathode regions, the electrolyte being at least one selected from: an alkali metal salt, an alkaline earth salt; an onium salt, an aromatic or alkyl amine, a primary, secondary or tertiary amine salt, or a hydrogen halide;

f. adding an oxidizable anodic reactant to the anode region;

g. adding a phase transfer agent to at least one of the anode region and the cathode region; and h. applying a source of energy across the anode and cathode to reduce the carbon dioxide and produce an oxidation product.

2. The method according to claim 1, further including the step of transporting carbon dioxide reduction product and anode oxidation product to a region outside of the cell.

3. The method of claim 1 where adding comprises flowing.

4. The method according to claim 1, wherein the ion permeable zone between the anode region and the cathode region is one of (i) the interface between the anolyte and the catholyte, (ii) an ion selective membrane, (iii) at least one liquid layer comprising an emulsion or (iv) a hydrophobic or glass fiber separator.

5. The method according to claim 1, wherein the phase transfer agent is selected based upon the electrolyte.

6. The method according to claim 1, wherein solvents flow through the anode and cathode regions and the flow through the anode region is counter to the solvent flow through the cathode region.

7. The method according to claim 1, further comprising the step of heating the anode region during operation of the cell to above about 60° C.

8. The method according to claim 1, further comprising the step of selecting the phase transfer agent based upon whether cation transfer from one region to the other is selective.

9. The method according to claim 1, further comprising the step of selecting the phase transfer agent to lessen drag of water into the separation and cathode regions.

* * * * *